United States Patent [19]

Calvino

[11] Patent Number: 4,486,633

[45] Date of Patent: Dec. 4, 1984

[54] HIGH-VOLTAGE Y-SHAPED DEAD TANK CIRCUIT INTERRUPTER

[75] Inventor: Ben J. Calvino, Monroeville, Pa.

[73] Assignee: Westinghouse Electric Corp., Pittsburgh, Pa.

[21] Appl. No.: 405,479

[22] Filed: Aug. 5, 1982

[51] Int. Cl.[3] ..... H01H 33/54

[52] U.S. Cl. ..... 200/148 R; 200/148 A; 200/148 B; 200/148 D; 200/148 F

[58] Field of Search ..... 200/148 R, 148 A, 148 B, 200/148 D, 148 E, 148 F

[56] References Cited

FOREIGN PATENT DOCUMENTS 2038099 7/1980 United Kingdom ..... 200/148 R

*Primary Examiner*—Robert S. Macon

*Attorney, Agent, or Firm*—M. S. Yatsko

[57] ABSTRACT

A gas-insulated circuit breaker is described which includes a Y-shaped hollow grounded metal tank formed from three appropriately shaped pipes joined together. A hollow insulating bushing is secured to each upstanding leg. A stationary and a movable contact, separable from each other to establish an arc therebetween, are disposed in one of the upstanding legs, with an insulating gas disposed within both the tank and the insulating bushings. A mechanism is used for directing a blast of insulating gas into the arc established between the separating contact, and includes a piston fixedly disposed in the one leg and a puffer cylinder secured to the movable contact and movable over the piston to compress the gas therebetween. An operating mechanism is associated with the base leg for moving the movable contact, and a drive rod insulatably connects the movable contact and the operating mechanism. The operating mechanism thus moves the movable contact through the insulating drive rod.

7 Claims, 8 Drawing Figures

HIGH-VOLTAGE Y-SHAPED DEAD TANK CIRCUIT INTERRUPTER

CROSS-REFERENCE TO RELATED APPLICATIONS

Reference is made to the below-listed copending applications which are incorporated herein by reference and which are both assigned to the same assignee as the instant application:

A. "Puffer-Type Compressed-Gas Circuit Interrupter", Ser. No. 340,594, filed Jan. 19, 1982 by L. E. Berkebile.

B. "Dead Tank Gas-Insulated Puffer-Type Circuit Interrupter Having Interrupting Unit in Insulated Casing", Ser. No. 331,941, filed Dec. 17, 1981.

BACKGROUND OF THE INVENTION

This invention relates generally to circuit interrupting apparatus, and more specifically to a high-voltage, gas-insulated puffer-type circuit breaker having the interrupting unit disposed within the grounded, Y-shaped metallic tank.

High voltage power circuit breakers today are generally grouped into two classes: live tank and dead tank designs. A dead tank circuit interrupter generally is one in which the interrupting unit, with its separating contacts, is disposed within an electrically grounded metal tank which then is disposed on or at physical ground level. A live tank design, on the other hand, has its interrupting unit, with its separating contacts, disposed in an insulating housing which then is supported upon an insulating column. This difference in configuration is partially the result of the various regulatory codes in effect in both the United States and in foreign countries, which codes typically specify that the base of the insulators should be at a definite distance to earth independent of the voltage class considered, thereby implying that the lowest live part has to be at a distance to ground dependent on the voltage class and basic impulse level prescribed. In the case of the dead tank circuit breaker, the terminals correspond to the highest point of the circuit breaker and the lowest point of live parts. Conversely, in a live tank circuit breaker, these dimensions can vary depending on the interrupter chamber configuration; horizontal, oblique, vertical. These dimensions often define the height of the substation steel structures required, and considerable savings in substation structure costs can often be realized with a dead tank concept.

The dead tank circuit breaker also exhibits numerous advantages over the live tank circuit breaker. For example, the built-in current transformers which can be utilized with the dead tank circuit breaker provide significant economical advantages. Similarly, the dead tank circuit breakers present simplicity of erection and easy insulation coordination to ground, exhibit better size and withstand characteristics due to having a lower center of gravity and lighter live parts, and the interrupter mechanical support insulator and operating rod in the dead tank interrupter can be of small dimensions and not be subjected to ambient pollution.

SUMMARY OF THE INVENTION

In accordance with the present invention, a dead-tank circuit interrupter is disclosed which utilizes a Y-shaped, modular, grounded, metallic tank which may be used either singly, or in combination. When a single tank is employed with two terminal bushings extendng into the upper hollow legs thereof, a resultant two-break circuit interrupter is provided.

By using modular Y-shaped tanks, their manufacture and production, in large numbers, is easily obtained, resulting thereby in considerable cost reduction.

BRIEF-DESCRIPTION OF THE DRAWINGS

Figure 5:
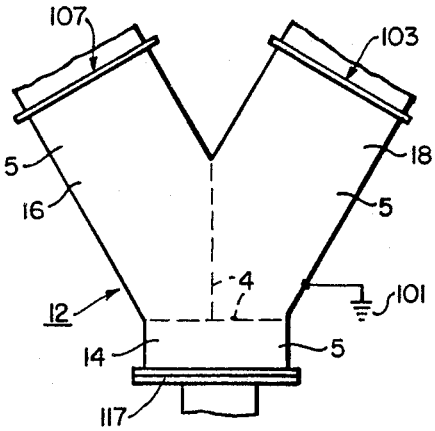
Figure 8:
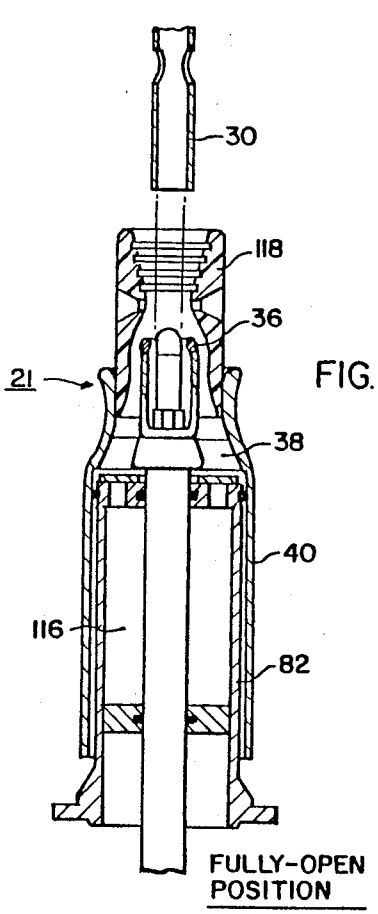
Figure 7:
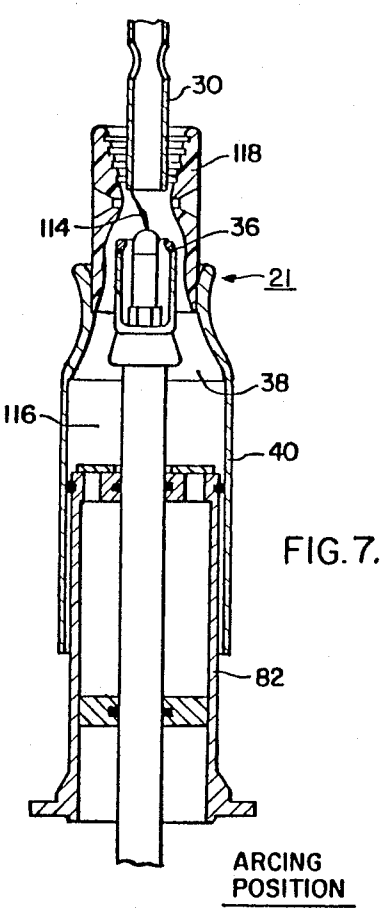
Figure 6:
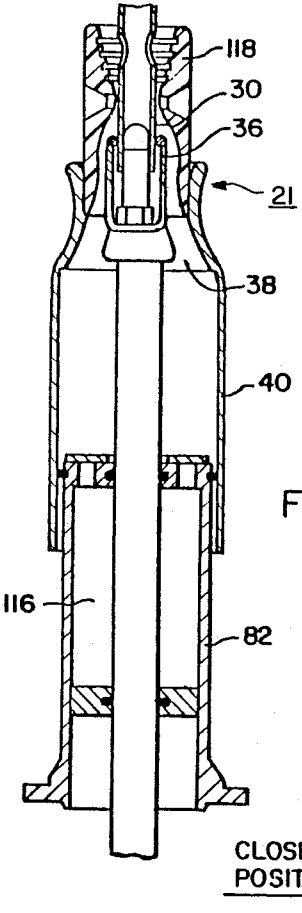

FIG. 5 illustrates a modular, Y-shaped, metallic tank which forms a modular "building block" element for interrupters of different voltages and current ratings; and FIGS. 6, 7 and 8 illustrate the essential interrupting elements of the arc-extinguishing units of the puffer type, FIG. 6 illustrating the puffer unit in the closed position, FIG. 7 showing the puffer unit in the arcing position, and FIG. 8 illustrating the puffer unit in the open-circuit position.

DESCRIPTION OF THE PREFERRED EMBODIMENTS

Figure 1:
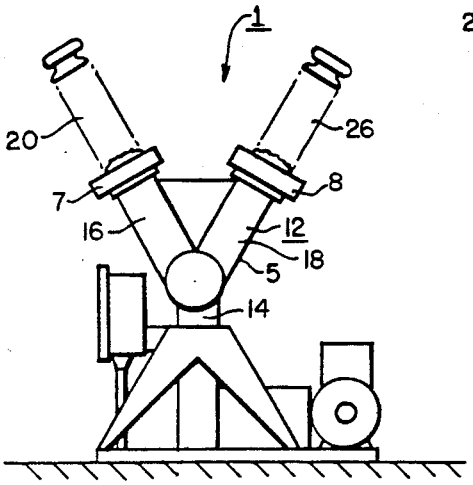
FIG. 1 illustrates a single-break, circuit interrupter of a voltage rating of, for example, 145 kv with one interrupting element.
Figure 2:
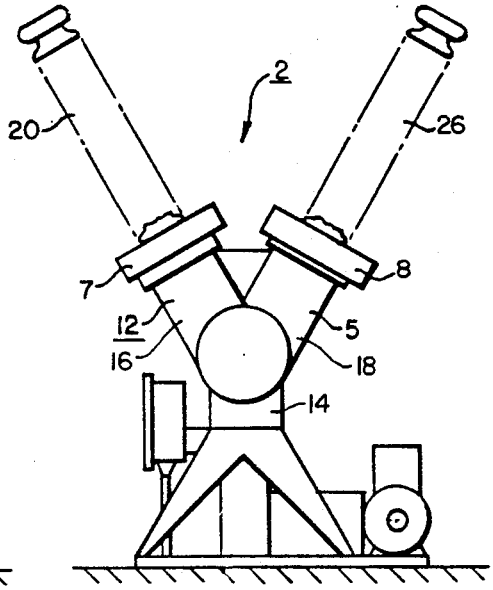
FIG. 2 illustrates a similar Y-shaped modular casing structure for a two-interrupting unit circuit interrupter having larger dimensions that in FIG. 1 and suitable, for example, for 245 or 362 kv ratings.

Referring to the drawings, and more particularly to FIGS. 1 and 2 thereof, it will be noted that these figures illustrate one and two-interrupting unit-types of circuit interrupters 1, 2 respectively having a modular, Y-shaped tank 12 formed of modular metallic tubular casing elements 5, and having a pair of outwardly disposed terminal bushings 20, 26 extending thereinto. As is customary, current-transformer structures 7, 8 may encircle the terminal bushings 20, 26 to measure the amperage of the line current passing through the circuit interrupters 1, 2.

As can be seen from FIG. 5, the Y-shaped tank 12 is electrically grounded as at 101, and is formed from, preferably, three equal-diameter pipes or casings 5 which are cut at the appropriate locations, designated by the dotted lines 4, so that they can be joined together to obtain the Y-shaped structure 12. The casings 5, once formed into their individual shapes, would be joined together by means such as welding to form a gastight, Y-shaped tank 12.

It should be appreciated that the construction of the tank 12 in this fashion results in significant manufacturing efficiencies. Instead of requiring a large, expensive, one-piece tank to be constructed, the tank 12 of this invention is made of three relatively low-cost pipes 5 which, by means of relatively simple cutting and welding operations, are formed into a gastight, Y-shaped tank 12 meeting the applicable regulatory codes. Furthermore, the tank 12 constructed as described has no extraneous openings which must be covered or otherwise made gastight.

As is apparent from FIG. 5, the Y-shaped tank 12, when constructed, results in a hollow base leg 14 and two hollow, upstanding legs 16, 18 to form the Y configuration. Disposed within either or both of the hollow upstanding legs 16, 18 (depending upon the voltage rating of the interrupter 1 or 2) is an arc-extinguishing, circuit-interrupter unit 21 of the compressed-gas puffer-type, illustrated in greater detail in FIGS. 6–8, the operation of which will hereinafter be described.

Figure 3:
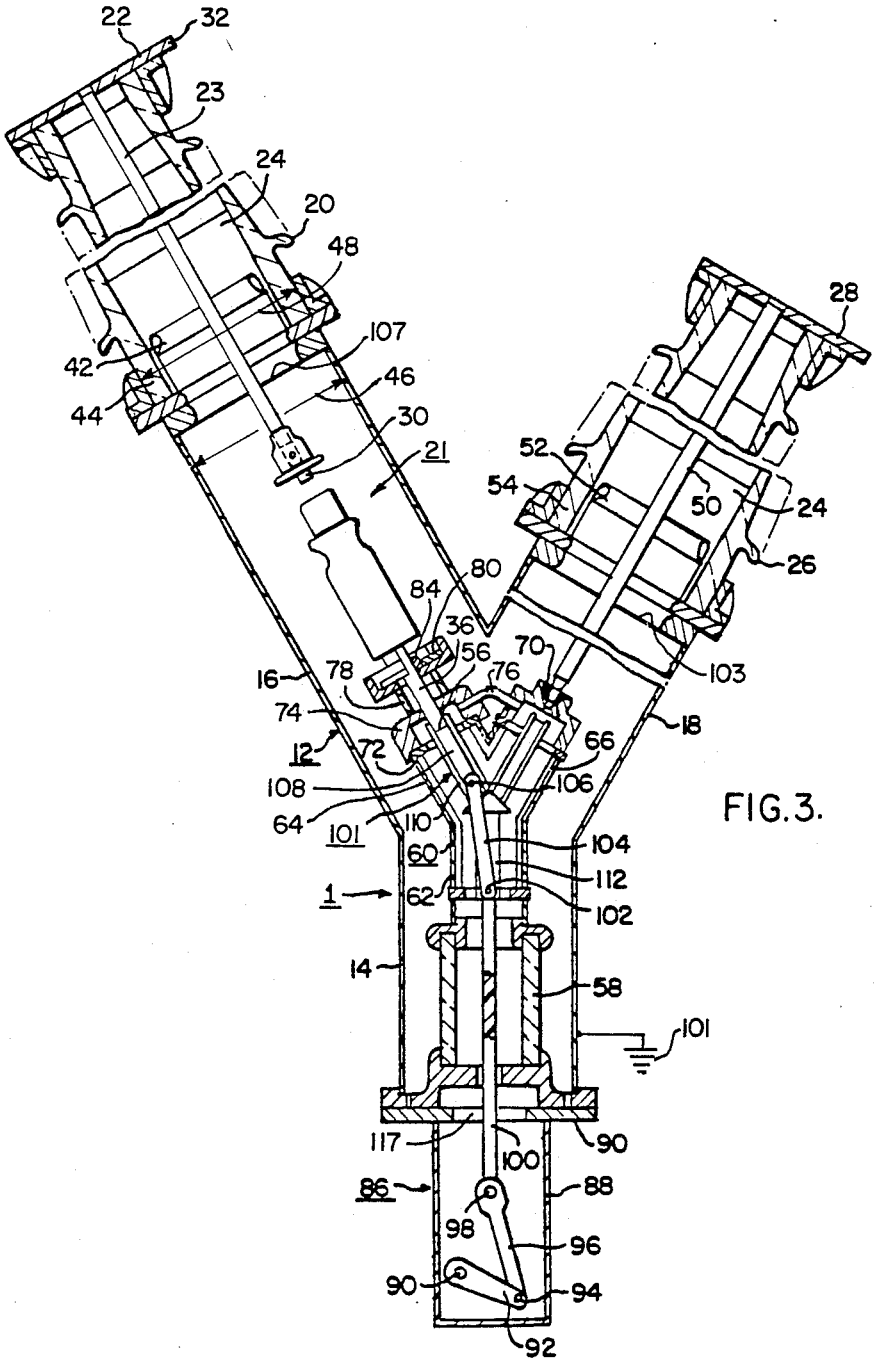
FIG. 3 illustrates in detail the circuit interrupter of FIG. 1, illustrating the internal interrupter unit structure with the interrupting units being illustrated in the open-circuit position.

Referring now more particularly to FIG. 3, it will be noted that secured to the upstanding leg 16 is a hollow insulating casing 20 which has a cover 22 secured thereto at the end distal from the leg 16 for preventing the escape of the insulating gas 24 which fills the interior of the casing 20 and the leg 16. Likewise, a hollow insulating casing 26 is secured to the base member leg 18 and the casing 26 has a cover 28 secured thereto to also prevent escape of the insulating gas 24 from the interior of the casing 26.

Disposed within the casing 20 is a bushing conductor 23 which is electrically connected to a first terminal 32 which would be connected, for example, to an incoming power line. The bushing conductor 23 is also connected to the stationary contact 30 which is disposed within the upstanding leg 16. The stationary contact 30 cooperates with the movable contact 36 which is also disposed within the upstanding leg 16 (see FIG. 6). The movable contact 36 is secured, through the spider 38, to a movable puffer cylinder 40, the function of which will hereinafter be described.

Disposed within the bushing 20 (see FIG. 3) is the bushing shield 42 which functions to control the electric field gradients at the end 44 of the bushing 20 where it is connected to the leg 16. Also to be noted is that the leg 16 has an outside diameter 46 which is the same as the bushing outside diameter 48 at the location where the bushing 20 is secured to the leg 16.

Disposed in the other bushing 26 is a bushing conductor 50 which is electrically connected to the end cover 28 which also functions as a line terminal which may be connected, for example, to an outgoing electrical power line. As before, an electrical grading shield 52 is disposed within the bushing 26 to control the electrical gradients at the base 54 of the bushing 26 where it is secured to the upstanding leg 18.

Disposed on the insulating support 58 within the tank 12 is a Y-shaped contact support 60 comprised of a contact support base 62 aligned with the base leg 14, and two angled contact support legs 64, 66 aligned with the legs 16, 18, respectively. The contact support leg 66 has at its outermost end a contact structure 70 which mates with the electrical conductor 50 to provide electrical contact and continuity therewith. The contact support leg 64 has secured to the end 72 thereof the transfer support 74. The transfer support 74 is electrically connected to the contact structure 70 by means of the shunt element 76.

The transfer support 74 supports the interrupter support 78 which is aligned with the leg 16 and which supports the contact structure 80. The contact structure 80 physically supports the stationary puffer piston 82 within the upstanding leg 16, and further provides electrical continuity, through the contacts 84, between the movable contact 36 and the interrupter support 78. Thus, the electrical path through the interrupter 10 is complete, when the contacts are in the closed position, from the incoming line (not shown) through the terminal 32, the bushing conductor 23, the stationary contact 30, the movable contact 36, the contacts 84 and the contact support 80, through the interrupter support 78, the transfer support 74, the shunt 76, the contact structure 70, and the bushing conductor 50 to the terminal 28.

Associated with the base leg 14 is an operating mechanism 86. This operating mechanism 86, although illustrated as being contained within the housing 88 which is secured to the bottom flange 90 which encloses the base leg 14 of the tank 12, may instead be included within the base leg 14 if such base leg 14 is constructed more elongated than that illustrated. The operating mechanism 86 is comprised of a drive shaft 90 which would extend through the housing 88 to externally of the circuit breaker and be connected either to a manual handle (not shown) or to a pneumatic operating mechanism (not shown) of the type illustrated in U.S. Pat. No. 4,110,578. The drive shaft 90 is fixedly connected to the drive lever 92 which in turn is pivotally connected, as at 94, to the link 96. The link 96 is pivotally connected at the pin 98 to an insulating drive rod 100 which extends into the base leg 14 and into the contact support base section 62. The insulating drive rod 100 is, in turn, pivotally connected as at 102 to a connecting link 104 which itself is pivotally connected at 106 to the operating rod 108. The operating rod 108 is itself fixedly connected to the movable contact 36 as at 56, and the operating rod 108 is reciprocally movable within the operating rod guide 110 which is supported by the contact support 74. The operating mechanism 86 thus is capable of providing the reciprocating movement of the movable contact 36 by means of the drive rod means 101 which comprises the operating rod 108, the link 104, and the drive rod 100.

The operation of the circuit breaker 10 can best be understood with reference sequentially to FIGS. 3 and 6–8. In FIG. 6, the movable contact 36 is physically contacting the stationary contact 30, in a position in which the contacts are closed. As the breaker is operated (see FIG. 3), the drive shaft 90 is rotated in the clockwise direction, which causes a corresponding clockwise rotation of the lever 92. This clockwise rotation of the lever 92 causes a downward movement of the link 96, which causes a corresponding downward movement of the drive rod 100 as it moves within its drive rod guide 112. The downward movement of the drive rod 100 causes a downward movement of the link 104 which causes movement of the operating rod 108 within the guide 110. Movement of the operating rod 108 causes a downward movement of the movable contact 36, causing it to separate from the stationary contact 30 and results in the establishment of an arc 114 between the stationary contact 30 and the movable contact 36 (FIG. 7). Downward movement of the movable contact 36 also caused a downward movement of the puffer cylinder 40 which is secured to the movable contact 36, and the movable puffer cylinder 40 has moved over the stationary piston 82 to compress the gas 24 in the area 116 between the cylinder 40 and the piston 82. The gas which was compressed in the area 116 increases in pressure and as the contacts 30, 36 continue separating, this gas blasts into the arc 114 between the separating contacts 30, 36, directed by the insulating nozzle 118 which is secured to the puffer cylinder 40. This blast of insulating gas functions to extinguish the arc 114 thereby providing interruption of the current flow in the circuit.

As shown in FIG. 8, continued operation of the operating mechanism 86 has caused complete separation of the movable contact 36 from the stationary contact 30, and electric current can no longer flow between the terminals 32, 38.

As can be seen, the open circuit position of the stationary and movable contacts 30, 36, respectively, occurs within the upstanding leg 16 of the grounded Y-shaped tank 12. By so locating the contacts 30, 36, a safer, more compact circuit interrupter 1 has been achieved.

Figure 4:
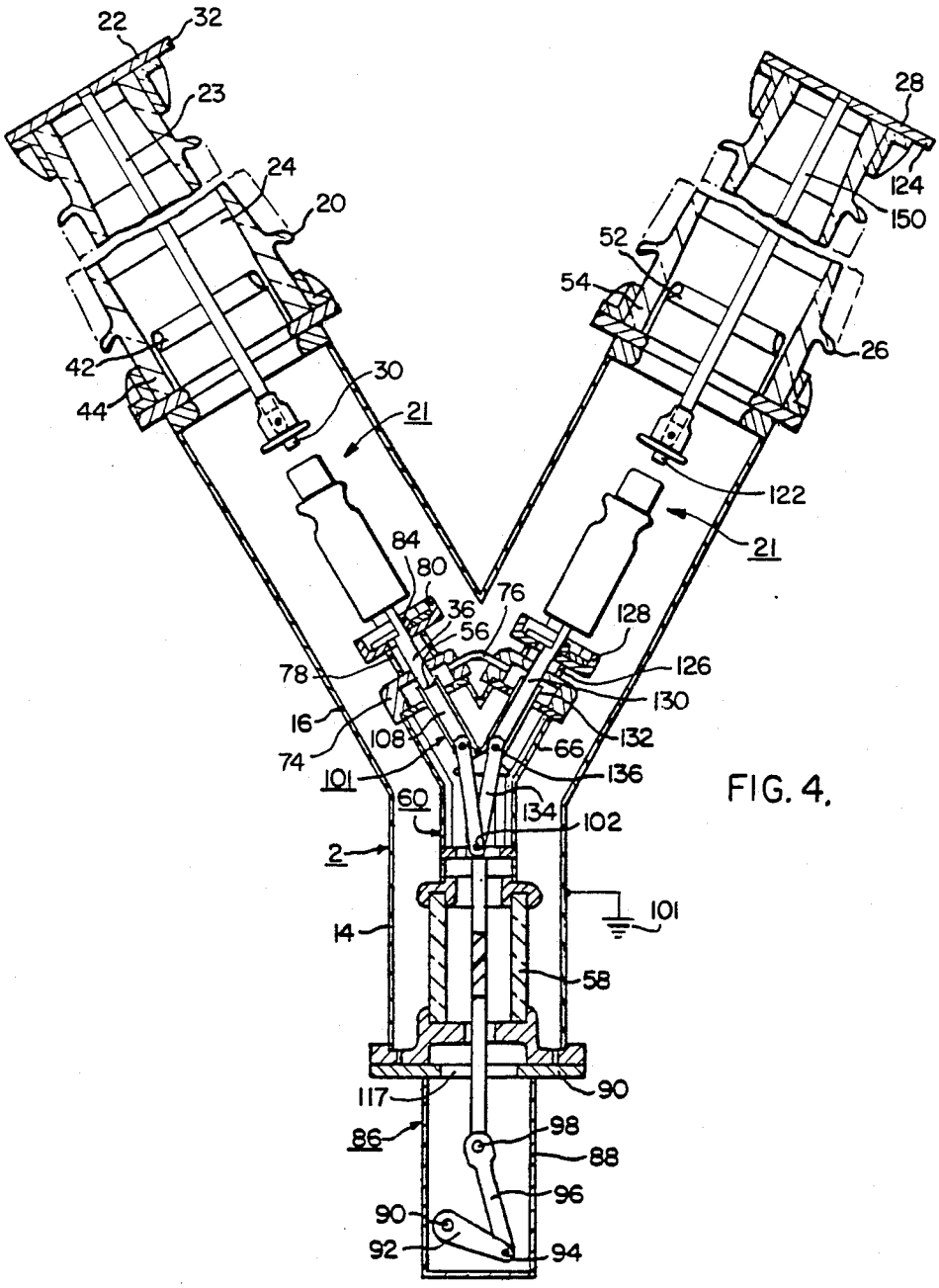
FIG. 4 is a view showing the internal interrupter unit elements of the two interrupting unit circuit interrupter of FIG. 2 in greater detail, the interrupter unit elements being illustrated in the open-circuit position.

Referring now more particularly to FIGS. 2 and 4, therein is shown a modification of the circuit breaker of FIGS. 1 and 3 which is applicable for interrupting higher voltages. In this modification, the left side of the circuit breaker (as shown in the drawings) is identical to that as previously described. The righthand side of the circuit breaker, however, has been changed in that the electrical conductor 50 is no longer disposed in the leg 18. Instead, a stationary contact 122 is fixedly secured within the leg 18 and is electrically connected to a bushing conductor 150 which in turn is secured to the terminal 124. The contact support structure 66 includes an interrupter support 126 which supports a contact structure 128 which, in turn, fixedly supports the second puffer piston 82 in the upstanding leg 18. A second movable contact 36 cooperates with the stationary contact 122 in the leg 18 to provide a second interrupting unit. The movable contact 36 is fixedly secured through a spider 38 to the puffer cylinder 40, which puffer cylinder 40 is slidable over the fixed puffer piston 82 to compress the gas in the area therebetween. A second operating rod 130 is connected to the movable contact 36, which operating rod 130 is reciprocally movable within the guide 132. A second connecting link 134 is pivotally secured as at 136 to the second operating rod 130, and the other end of the connecting link 134 is pivotally connected to the drive rod 100 at the same location as is the first connecting rod 104, that is at the pivot point 102. Thus, operation of the operating mechanism 86 moves both movable contacts 36 at the same time. The interruption, the movement, and the interaction of the stationary and movable contacts in the leg 18 occurs as was previously described with respect to the interrupting unit disposed in the leg 16 as is shown in FIGS. 6–8. With the two movable contacts 36 in the two legs 16, 18, the movable contact 36 in the leg 18 is electrically connected to the contact supply assembly 70, which in turn is electrically connected to the transfer support 74 by means of the shunt 76. By being so connected, the movable contacts are electrically serially connected, and interruption of the current between terminals 28 and 32 occurs in two breaks instead of the one break as in the previous embodiment.

As can be seen in FIGS. 3 and 4, both the stationary contact 30 and the movable contact 36 are axially aligned with the upstanding legs 16, 18. The reciprocating movement of the movable contact 36 occurs along the center line axis of the legs 16, 18. The stationary contact 30 is directly electrically secured to the conductor, for example 23 which extends along the length of the bushing 20. Although not illustrated, the stationary conductor 30 can be supported from any location along the length of the bushing 20 since the stationary contact 30 and the bushing 20 are axially in alignment.

As is apparent from the figures, the disclosed Y-shaped circuit interrupter 1, 2 provides a very compact, safe circuit interrupter. The grounded tank 12 contains the arc-extinguishing units 21 and this provides a high degree of safety to operating personnel. The tank 12 by being formed from three pipes 5, is inexpensive to fabricate, and contains no extraneous openings which must be covered. As designed, the Y-shaped tank has only three openings; a first opening 117 at the bottom of the base leg 18 which is sealed by the housing 88; and two openings 107, 103 at the ends of the legs 16, 18, which are sealed by the bushings 20, 26, respectively secured thereto. Thus, there is no other locale through which the insulating gas 24 can escape from inside the tank 12.

I claim:

1. A gas-insulated circuit interrupter comprising:

a Y-shaped, metal, grounded hollow tank comprising three equal diameter pipes appropriately shaped to join together to form said Y shape, said pipes being gastightly secured to each other, said Y-shaped tank having a base leg and two diverging upstanding legs, said base leg being formed of one of said pipes with said base leg pipe end at the location of its joinder to the other two pipes being cut along a line at a right angle to the axial length of said base leg pipe;

an insulating gas disposed within said tank;

an arc-extinguishing unit disposed in each of said diverging upstanding legs and electrically serially connected to each other; and operating means disposed in said tank and extending through said base leg for simultaneously operating said arc-extinguishing units.

2. The circuit interrupter according to claim 1 wherein said operating means includes sealing means for gastightly sealing said base leg.

3. The circuit interrupter according to claim 1 including a terminal bushing sealingly secured to each of said diverging upstanding legs.

4. A gas-insulated dead tank circuit interrupter comprising:

a Y-shaped, metal, grounded hollow tank comprising a base leg and first and second diverging upstanding legs;

an insulating gas disposed within said tank;

a first bushing axially aligned with said first leg sealingly secured to, and disposed entirely external to, said first leg and having a first bushing conductor coaxially disposed therein;

a second bushing axially aligned with said second leg sealingly secured to, and disposed entirely external to, said second leg and having a second bushing conductor coaxially disposed therein;

a first stationary contact axially aligned with said first leg disposed within said first leg and electrically connected to said first bushing conductor;

a second stationary contact axially aligned with said second leg disposed within said second leg and electrically connected to said second bushing conductor;

a first movable contact axially aligned with said first leg disposed within said first leg and operable between open and closed positions with respect to said first stationary contact;

a second movable contact axially aligned with said second leg disposed with said second leg and operable between open and closed positions with respect to said second stationary contact;

means for electrically serially connecting said first and second movable contacts; and operating means associated with said base leg for effecting simultaneous opening and closing movements of said first and second movable contacts.

5. A gas-insulated dead tank circuit interrupter comprising:

a Y-shaped, hollow grounded metal tank having a base leg and two angularly extending legs;

a hollow insulating bushing secured to each base member leg and having a cover secured to the end thereof distal from said base member leg;

a stationary contact disposed in one of said angularly extending legs;

a movable contact disposed in said one angularly extending leg and separable from said stationary contact to establish an arc therebetween;

an insulating gas disposed within said base member and said casing;

means disposed within said one angularly extending leg for directing a blast of insulating gas into the arc established between said separating contacts comprising a piston fixedly disposed in said one angularly extending leg and a puffer cylinder secured to said movable contact and movable over said piston to compress the gas therebetween;

operating means associated with said base member support section for moving said movable contact;

a bushing conductor disposed in the other of said angularly extending legs and extending through said bushing associated therewith, said conductor being electrically serially connected to said movable contact; and a Y-shaped contact support insulatably supported within said tank and including two angled contact support legs aligned with said upstanding legs and said busings, one of said contact support legs supporting said piston in said one leg and being electrically connected to said movable contact, the other of said contact support legs being electrically serially connected to said bushing conductor.

6. A dead tank, gas-insulated circuit interrupter comprising:

a Y-shaped, metal, hollow-grounded tank containing an insulating gas, said tank comprising a base leg and two diverging upstanding legs formed by gas-tightly securing together three equal-diameter pipes having appropriatory shaped cuts therefrom with at least one cut being at a right angle to the direction of the axial length of the associated pipe;

a stationary contact axially aligned with, and disposed within, one of said upstanding legs;

a movable contact axially aligned with, and disposed within, said one upstanding leg, said movable contact operable between open and closed positions with respect to said stationary contact; and operating means for moving said movable contact between said open and closed positions.

7. The circuit interrupter according to claim 4 or 6 including means for directing a blast of insulating gas into the arc established between said stationary and movable contacts during an opening operation.

* * * * *